US005150679A

United States Patent [19]

Peter

[11] Patent Number: 5,150,679

[45] Date of Patent: Sep. 29, 1992

[54] ELECTRONIC BUTTERFLY VALVE ADJUSTER HAVING CONTINUOUS FAULT MONITORING SYSTEM

[75] Inventor: Cornelius Peter, Ottersweiher, Fed. Rep. of Germany

[73] Assignee: Robert Bosch GmbH, Stuttgart, Fed. Rep. of Germany

[21] Appl. No.: 720,460

[22] PCT Filed: Jan. 12, 1989

[86] PCT No.: PCT/EP89/00024

§ 371 Date: Jun. 21, 1991

§ 102(e) Date: Jun. 21, 1991

[87] PCT Pub. No.: WO90/08251

PCT Pub. Date: Jul. 26, 1990

[51] Int. Cl.[5] ..... F02D 11/10; F02D 41/22

[52] U.S. Cl. ..... 123/397; 123/333; 123/399; 73/118.1

[58] Field of Search ..... 123/396, 397, 399, 361, 123/333; 73/118.1

[56] References Cited

U.S. PATENT DOCUMENTS

| | | | |
|---|---|---|---|
| 4,305,359 | 12/1981 | Mann et al. | 123/399 |
| 4,519,360 | 5/1985 | Murakami | 123/399 |
| 4,603,675 | 8/1986 | Junginger et al. | 123/399 |
| 4,960,091 | 10/1990 | Aufmkolk | 123/399 |

FOREIGN PATENT DOCUMENTS

| | | |
|---|---|---|
| 3643946 | 6/1988 | Fed. Rep. of Germany . |
| 59158343 | 1/1985 | Japan . |
| 60-79130 | 9/1985 | Japan . |
| 63-61748 | 8/1988 | Japan . |

OTHER PUBLICATIONS

"Möglichkeiten komfortabler Testgeräte zur Auswertung der Eigendiagnose von Steuergeräten im Kraftfahrzeug" by D. Nemec, VDI berichte, No. 68, 1988, pp. 365–385.

*Primary Examiner*—Andrew M. Dolinar
*Attorney, Agent, or Firm*—Walter Ottesen

[57] ABSTRACT

An electronic butterfly valve adjusting mechanism wherein the current supply to the adjusting motor (6), which is equivalent to the sum of all of the mechanical moments acting on the motor shaft, is monitored and a "window" is preselected within which the motor current/moment must lie if the butterfly valve and its adjusting components are operating normally. If, in the static case, the sum of all of the mechanical moments acting on the motor shaft is detected to be outside the "window" then it is concluded that a mechanical fault condition exists and the maximum possible angle of the butterfly valve is arranged to be reduced to a safe level. The driver can also be warned by a suitable visual signal.

2 Claims, 3 Drawing Sheets

ELECTRONIC BUTTERFLY VALVE ADJUSTER HAVING CONTINUOUS FAULT MONITORING SYSTEM

FIELD OF THE INVENTION

The present invention relates to butterfly valves used in controlling the performance of internal combustion engines and is concerned in particular with such butterfly valves of the type wherein the operating position of the butterfly valve spindle is controlled electronically.

BACKGROUND OF THE INVENTION

In general, butterfly valves are arranged to be normally biased towards a closed position by, inter alia, two restoring elements which are independent of one another. In the case of mechanical systems operated by, for example, a Bowden cable linkage, the restoring elements comprise two separate springs. In a conventional electronically controlled butterfly valve, the two restoring elements comprise one spring and an electronic adjusting element.

If one of the two restoring elements should fail in operation, the second restoring element (provided as a duplicate) always fulfills the safety critical closing function—it being essential that, in the event that the driver is not depressing the accelerator pedal, the engine is always returned to a minimum speed (idling) condition. Once one restoring element has failed, there is, of course, no duplication available, and it is essential for the driver to be warned and for him to seek a workshop for the faulty part to be replaced. This is especially important in the case of electronic systems, since a fault in the return spring in the adjusting element does not readily become apparent immediately because the pedal forces remain unaltered as a result of the mechanical decoupling between the pedal and the butterfly valve unit.

The Abstract of JP-A-60-79130 shows a throttle flap control device. The current of the driving motor, which controls the position of the throttle flap according to the output of an accelerator position sensor and a throttle position sensor, is detected as a reference value. The detected current is not used for checking purposes.

From the document "VDI-Berichte" No. 687, 1988, pages 365 to 385, it is known that for self-checking purposes, the current which is supplied to the actuators of an engine is monitored. A failure of the system is recognized when the current exceeds an upper or a lower limit value.

However, the above-cited problems concerning mechanical fault conditions in electronic systems cannot be avoided. The mechanical fault conditions may not become apparent by comparing the detected current value with the upper or the lower limit value as described in the above-cited document, because the electronic system controls the throttle flap position according to the accelerator position even for example in the absence of a return spring. The detected current value may not exceed the predetermined upper or lower nominal limit value.

SUMMARY OF THE INVENTION

It is an object of the present invention to provide a means by which the driver is notified of a broken return spring or other mechanical defects of the butterfly valve spindle in an electronically controlled butterfly valve system so as to avoid the existence of safety-critical states in these conditions.

The electronic control system of the invention is for a butterfly valve in the intake system of a motor vehicle engine wherein the operating position of the butterfly valve is controlled according to an accelerator position. The electronic control system includes: an electronically controlled adjusting device including an adjusting motor for driving the butterfly valve in an opening or closing direction in accordance with a control signal and a current supply for supplying a supply current to the adjusting motor; a return spring which continuously biases the butterfly valve towards a closed or idling position of the valve; a position sensor which outputs an electrical signal representative of the actual prevailing position of the butterfly valve; means for monitoring the supply current to the adjusting motor of the adjusting device; means for determining limit values as a function of the actual position of the throttle flap according to the sum of all the mechanical moments occurring in the adjusting device; and, means for detecting a fault condition when the supply current is outside the predetermined limits.

This affords the advantage that the mechanical operation of the butterfly valve and its adjusting mechanism can be tested continuously during travel, and the operation of the butterfly valve can be limited to safe ranges even if a fault does occur.

BRIEF DESCRIPTION OF THE DRAWINGS

The invention is described further hereinafter, by way of example only, with reference to the accompanying drawings, in which.

DESCRIPTION OF THE PREFERRED EMBODIMENTS OF THE INVENTION

The butterfly valve spindle, its drive and the duplicate return spring are all integral components of an electronic butterfly valve adjuster and, as a result, the operating forces and moments occurring in the device are known. (The constructional details of such butterfly valve adjusters are well known to those familiar with the art and will not be described again here). Because of the mechanical coupling therebetween, the moments acting on the butterfly valve spindle are accurately reproduced on the shaft of the adjusting motor.

Figure 1:
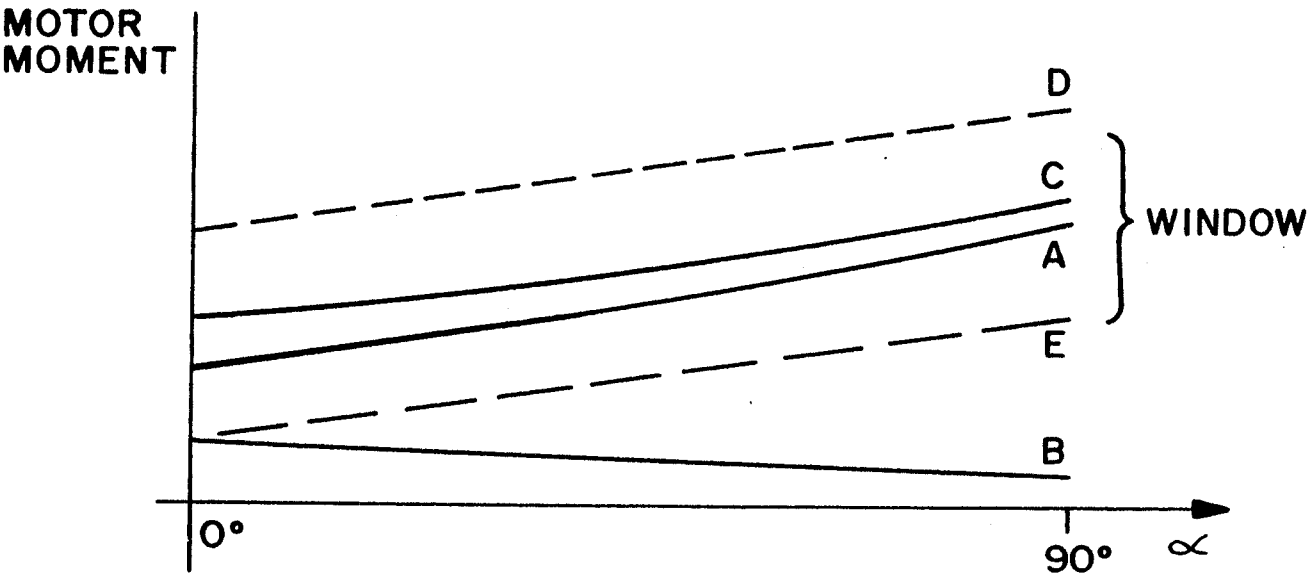
FIG. 1 illustrates graphically the operating characteristics of a typical electronically controlled butterfly valve.

FIG. 1 is a graph showing how the principal moments acting on the butterfly valve spindle vary with the opening angle of the butterfly valve. Line A indicates the moment resulting from the return spring. Line B indicates the moment resulting from the operational air forces acting on the butterfly valve. Line C indicates the resultant total moment of the valve spindle. In a normal operating condition, the sum of all of the mechanical moments acting on the butterfly spindle, and therefore on the motor shaft, must therefore always lie within a "window" in the static case which is compensated by an equal and opposite motor moment. The width of the window must take into account such variables as friction hysteresis between relatively moving parts, the range of permissible operating temperatures, mechanical tolerances and like operational variables. This "window", within which the motor moment can be injected to lie if all is normal, is indicated in FIG. 1 as the band disposed between lines D and E. The resultant motor moment in any given case is in turn reproduced by the motor current whose value can be monitored by a control unit.

Thus, by monitoring whether the motor current remains with a range corresponding to the motor moment remaining within the predetermined window, it can be determined whether the butterfly valve spindle moment lies within a corresponding normal range of values. If it does not, then a fault condition is diagnosed and a suitable visual and/or audible indication given to the driver.

Figure 2:
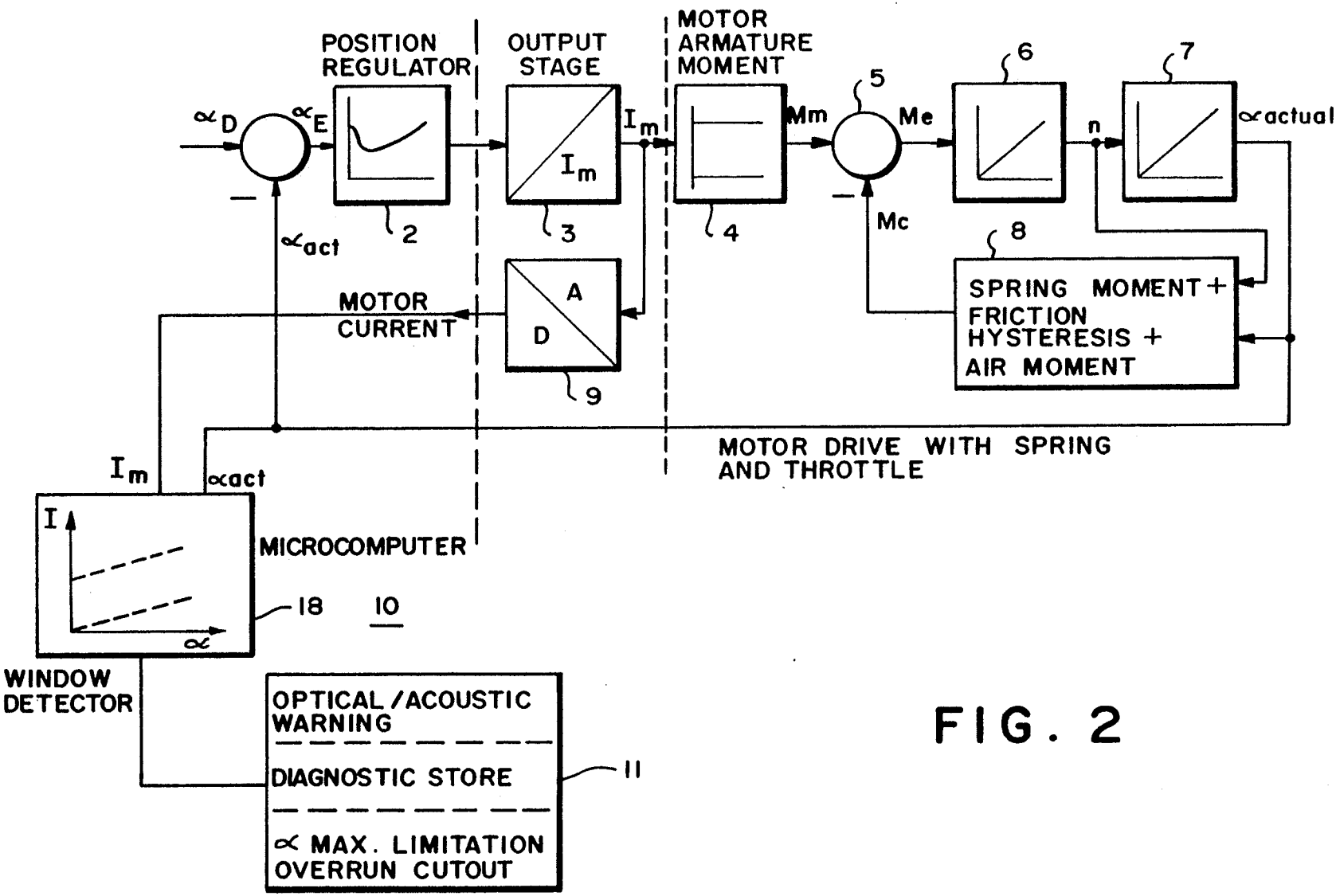
FIG. 2 is a block circuit diagram of one embodiment of an electronic butterfly adjuster in accordance with this invention.

FIG. 2 shows one embodiment of an electronic butterfly adjuster having such a window monitoring facility. Signal $\alpha D$ is an electrical signal from a throttle pedal transducer and is representative of a desired opening angle $\alpha$ of the butterfly valve. Block 2 represents a position regulator which is adapted to adjust the position of the motor shaft, and hence the butterfly valve angle in accordance with an error signal $\alpha E$ representing the difference between the desired opening angle $\alpha D$ and the actual opening angle $\alpha A$. The output stage of the position regular (block 3) provides an output current Im representative of the motor driving the butterfly valve spindle. Block 4 interprets the motor current Im in terms of motor armature moment and outputs a motor moment signal Mm. From this motor moment signal Mm there is subtracted at block 5 a signal Mc representative of the sum of all the mechanical moment components acting upon the motor shaft, namely those attributable to the return spring, friction hysteresis between relatively moving parts of the system and air pressure on the butterfly valve itself. The resulting moment Me is then applied to the motor driving the butterfly valve spindle (indicated diagrammatically by block 6). The position of the butterfly valve spindle is reproduced electrically by the output of a position sensor (indicated diagrammatically by the block 7). Signals representative of the motor speed n and of the position adopted by the position sensor ($\alpha$actual) are passed to a block 8 to generate the signal Mc representative of the sum of the mechanical moments acting on the motor shaft (that is, spring moment, friction hysteresis and air moment).

In this arrangement, the moments acting on the butterfly spindle are accurately reproduced on the shaft of the adjusting motor. The sum of all the mechanical moments acting upon the motor shaft in the static case must then always lie within a "window" (see FIG. 1) (allowing for friction hysteresis, range of temperature, tolerances), and is compensated by an equal and opposite motor moment. This motor moment is in turn reproduced in the motor current Im which is returned to a control unit (not shown) in the main microcomputer 10 (see FIG. 2) via an analog/digital converter 9. When this current Im is detected in block 10 to lie above or below predetermined limits corresponding to the moment "window", it can be concluded that there is a mechanical fault condition in the adjusting mechanism for the butterfly valve. In particular, negative currents indicate a broken spring or a jamming drive. In the event of a fault condition being detected, the microcomputer 10 (block 11) is arranged to reduce the maximum possible angle of the butterfly valve to a safe value or to limit the output power of the engine by other means, for example by fuel cutoff or other overrun cutout, and/or to activate a warning lamp for the driver. The information would normally also be deposited in the diagnostic store, if one is fitted.

Figure 3:
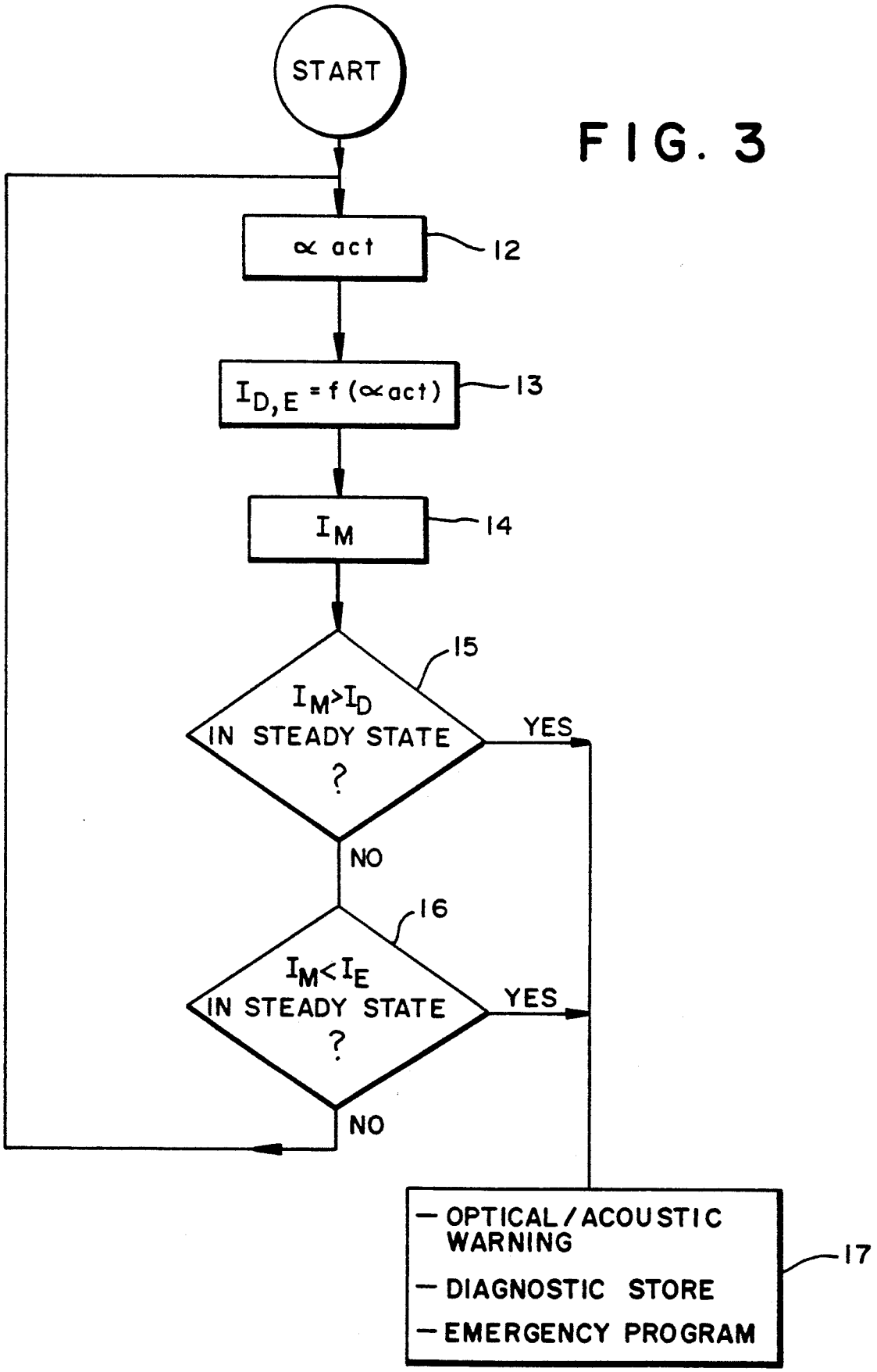
FIG. 3 is a basic flow diagram illustrating the operation of the system of FIG. 2.

In the simplified flow diagram of FIG. 3, $\alpha$actual is detected at step 12. The upper and lower limits of motor current $I_D$, $I_E$ are set as a function of $\alpha$actual at step 13. Motor current is monitored at step 14. At step 15 it is determined whether, in the steady state, $I_M$ exceeds $I_D$ and at step 16 it is determined whether, in the steady state, $I_M$ is less than $I_E$. If the motor current $I_M$ leaves the window for more than a minimum preset period, then it can be concluded that a mechanical fault exists and, at step 17, an emergency program can be triggered, for example to limit $\alpha$max or, if the butterfly valve is jammed, to effect overrun or fuel cutout.

I claim:

1. An electronic control system of a butterfly valve in the intake system of a motor vehicle engine wherein the operating position of the butterfly valve is controlled according to an accelerator position, the electronic control system comprising:

an electronically controlled adjusting device including an adjusting motor for driving the butterfly valve in an opening or closing direction in accordance with a control signal; and, a current supply for supplying a supply current to said adjusting motor;

a return spring which continuously biases the butterfly valve towards a closed or idling position of the valve;

a position sensor which outputs an electrical signal representative of the actual prevailing position of the butterfly valve;

means for monitoring the supply current to said adjusting motor of the adjusting device;

means for determining limit values as a function of the actual position of the throttle flap according to the sum of all the mechanical moments occurring in the adjusting device; and, means for detecting a fault condition when the supply current is outside the predetermined limits.

2. The electronic control system of claim 1, wherein, in the event of a fault condition being detected, the maximum possible butterfly valve angle is arranged to be reduced to a safe value or the output power of the engine is arranged to be limited to a safe value, for example by fuel cutoff, and/or a warning signal is generated for the driver.

* * * * *